US005562967A

United States Patent [19]

Kikuchi et al.

[11] Patent Number: 5,562,967

[45] Date of Patent: Oct. 8, 1996

[54] WOVEN FABRIC/PLASTIC SHEET COMBINED STRUCTURE AND METHOD FOR CONSTRUCTING SAME

[75] Inventors: Koichi Kikuchi, Shimada; Mitugu Suzuki, Fuzieda, both of Japan

[73] Assignee: Kikuchi Web Tech Co., Ltd, Japan

[21] Appl. No.: 256,659

[22] PCT Filed: Nov. 9, 1993

[86] PCT No.: PCT/JP93/01629

§ 371 Date: Jul. 11, 1994

§ 102(e) Date: Jul. 11, 1994

[87] PCT Pub. No.: WO94/11552

PCT Pub. Date: May 26, 1994

[30] Foreign Application Priority Data

Nov. 9, 1992 [JP] Japan ..... 4-298675

[51] Int. Cl.[6] ..... B32B 3/10; B32B 31/00; B32B 29/02; D03D 13/00

[52] U.S. Cl. ..... 428/138; 139/383 R; 156/148; 156/155; 156/176; 156/293; 428/137; 428/196; 428/257; 428/220

[58] Field of Search ..... 428/257, 258, 428/259, 137, 138, 196, 220; 139/383 R; 156/148, 155, 176, 293

[56] References Cited

FOREIGN PATENT DOCUMENTS

| | | |
|---|---|---|
| 0152137 | 5/1985 | European Pat. Off. . |
| 3609845 | 3/1987 | Germany . |
| 649321 | 4/1985 | Switzerland . |

*Primary Examiner*—James D. Withers
*Attorney, Agent, or Firm*—Harris Beach & Wilcox

[57] ABSTRACT

This invention aims at providing a woven fabric having a structure suitable for bonding, so as to bond a so-called "tarpaulin sheet", which is bonded by sewing means and is obtained by coating a synthetic resin to a fiber base fabric, to a woven fabric such as a tape or a belt. The present invention further aims at providing a woven fabric having a structural portion enabling a woven fabric to be bonded to another woven fabric. A woven fabric 100 is divided in a longitudinal direction or in a transverse direction, or in both the longitudinal direction and the transverse direction, and either one, or both, of warps and wefts are woven more coarsely in at least one of the divided zones 22, 32 than the rest so as to form a mesh portion 2.

10 Claims, 6 Drawing Sheets

WOVEN FABRIC/PLASTIC SHEET COMBINED STRUCTURE AND METHOD FOR CONSTRUCTING SAME

FIELD OF THE INVENTION

This invention relates to a woven fabric having portions suitable for bonding so that bonding means by sewing according to the prior art can be changed to means for bonding by a synthetic resin, when a sheet and a woven fabric, which are coated with a synthetic resin on the surface thereof, or the woven fabrics, are bonded to each other and are used.

BACKGROUND AND SUMMARY OF THE INVENTION

When a tent, a flexible container, a material for civil engineering, etc., are produced, a so-called "tarpaulin sheet", which is produced by coating a synthetic resin on a fiber base fabric by a calendering process, etc., has been used widely. In most cases, a tape, a belt, etc., are joined by sewing so as to reinforce or bond the sheets or to bond them to other members. When a tent sheet is fixed to skeletal pipes of the tent when pitching the tent, for example, Japanese Utility Model Application No. 61-090926 provides a woven fabric for fitting the tent sheet. In this case, the center portion of the woven fabric for fitting the sheet in its transverse direction is bonded by sewing to the tarpaulin sheet of a tent base, both ends of the woven fabric for fitting the sheet in the transverse direction are wound on a pipe, and both terminals are then bound and fixed by a tape or a rope. In the case of the tarpaulin sheets, they can be easily bonded by radio frequency welding or thermal welding. However, if the tarpaulin sheet is used alone, the strength is not sufficient. Therefore, there is the problem that a rope must be sewn into a terminal of the sheet. The prior art reference described above proposes a woven fabric for fitting the sheet which solves this problem. However, it takes much labor to sew the woven fabric for fitting the sheet to the tent sheet and moreover, bonding work of sheet pieces for preventing water leakage from the sewn portions is necessary. Accordingly, utilization of bonding means of the woven fabric for fitting the sheet by radio frequency welding or thermal welding without relying on sewing has been desired. Further, if the woven fabrics can be bonded to each other by bonding means without using sewing so that the tarpaulin sheets can be bonded easily and mutually, the range of application will become broader. However, bonding means providing a peel strength which can withstand practical application has not yet been developed at all to this date.

The present invention aims at providing a woven fabric having a structure suitable for bonding in order to bond a so-called "tarpaulin sheet", which is obtained by coating a fiber base fabric with a synthetic resin, and a woven fabric such as a tape or a belt, which have been bonded in the past by sewing means, by bonding means.

To accomplish the object described above, the present invention employs the technical construction described below.

In other words, the present invention provides a woven fabric having a structural portion suitable for bonding wherein a woven fabric is classified in a longitudinal direction or a transverse direction or both in the longitudinal and transverse directions, and either one of the warps and wefts, or both of them, are woven very coarsely in at least one of the classified zones than in other zones in a mesh form.

Since the woven fabric according to the present invention employs the technical construction as described above, an adhesive permeates through the mesh portion and can exhibit a bridging effect at the mesh portion of the woven fabric. Accordingly, a synthetic resin coating sheet such as a tarpaulin sheet and a reinforcing woven fabric such as a tape, a belt, etc., can be bonded strongly and efficiently.

DETAILED DESCRIPTION OF THE DRAWINGS

Hereinafter, the woven fabrics having a structural portion suitable for bonding according to the present invention will be explained in further detail with reference to the drawings.

Figure 1:
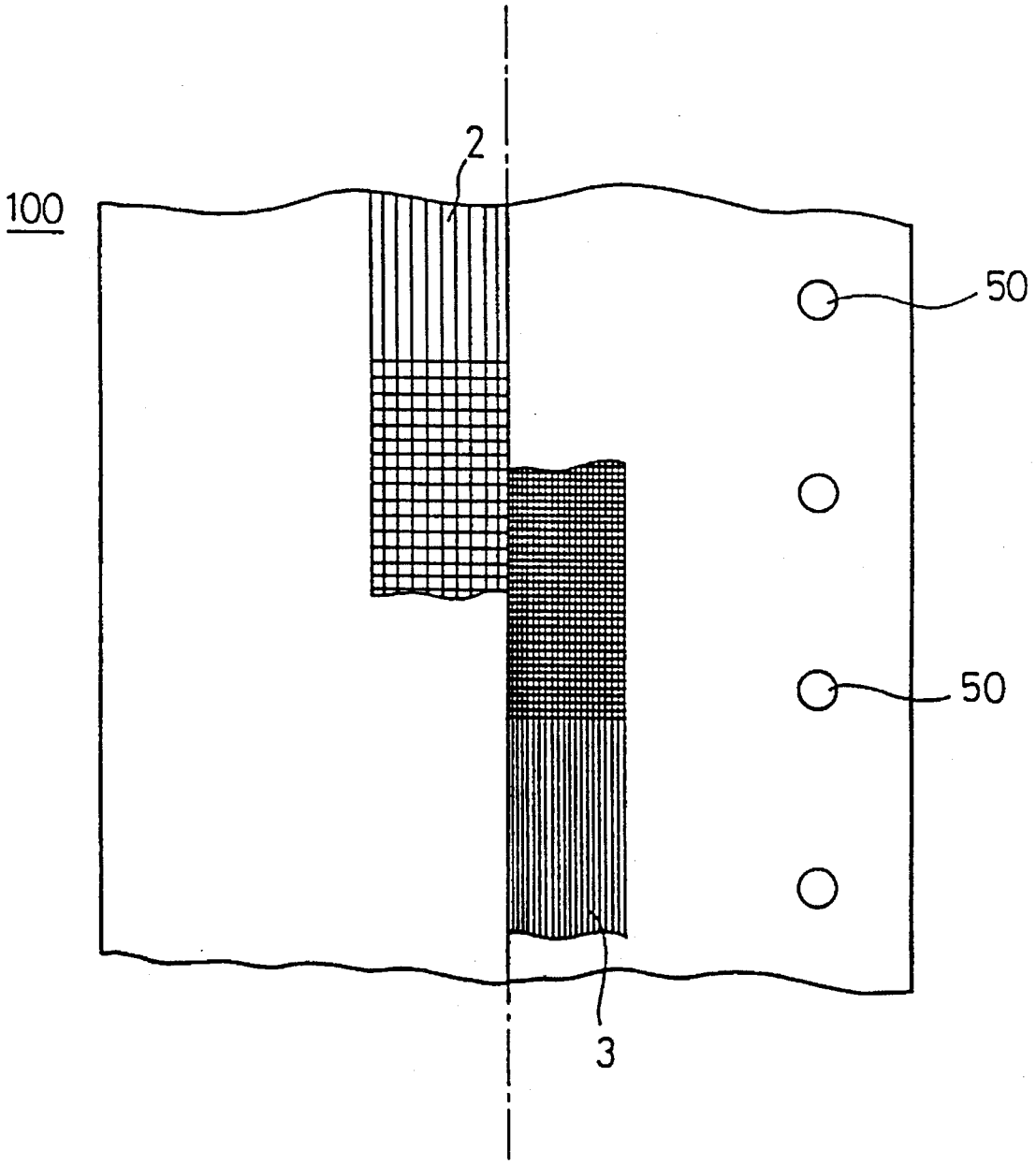
FIG. 1 is a view showing a first embodiment of a woven fabric having a structure suitable for bonding according to the present invention.
Figure 2:
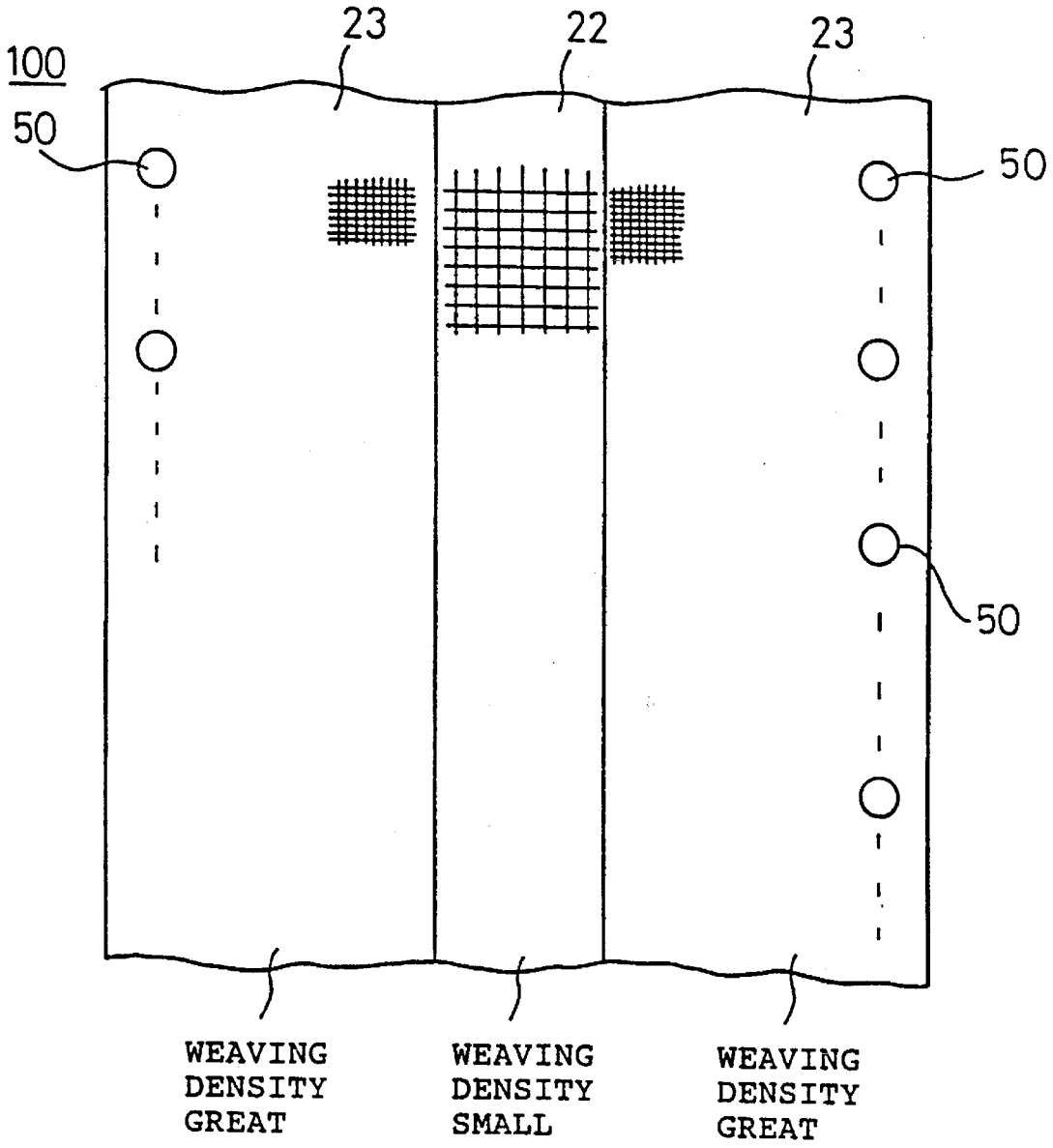
FIG. 2 is a view showing a second embodiment of the woven fabric having a structure suitable for bonding according to the present invention.
Figure 3:
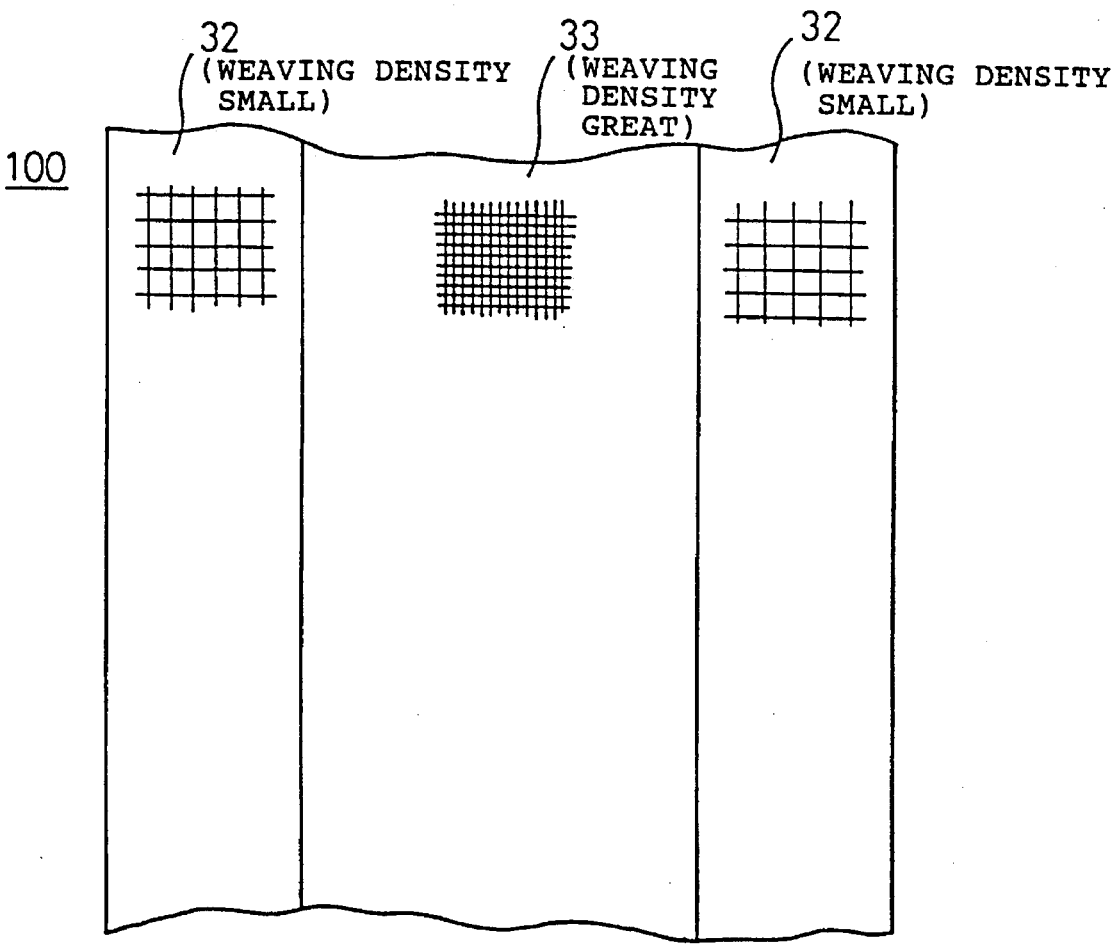
FIG. 3 is a view showing a third embodiment of the woven fabric having a structure suitable for bonding according to the present invention.
Figure 4A:
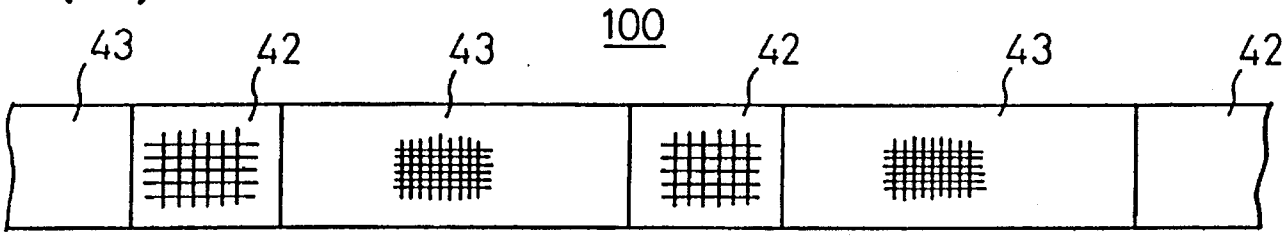
FIG. 4A is a view showing a fourth embodiment of the woven fabric having a structure suitable for bonding according to the present invention.
Figure 4B:
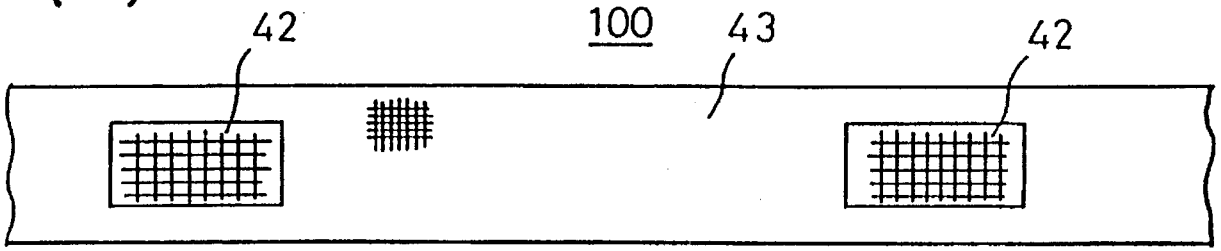
FIG. 4B is a view showing a fifth embodiment of the woven fabric having a structure suitable for bonding according to the present Invention.
Figure 4C:
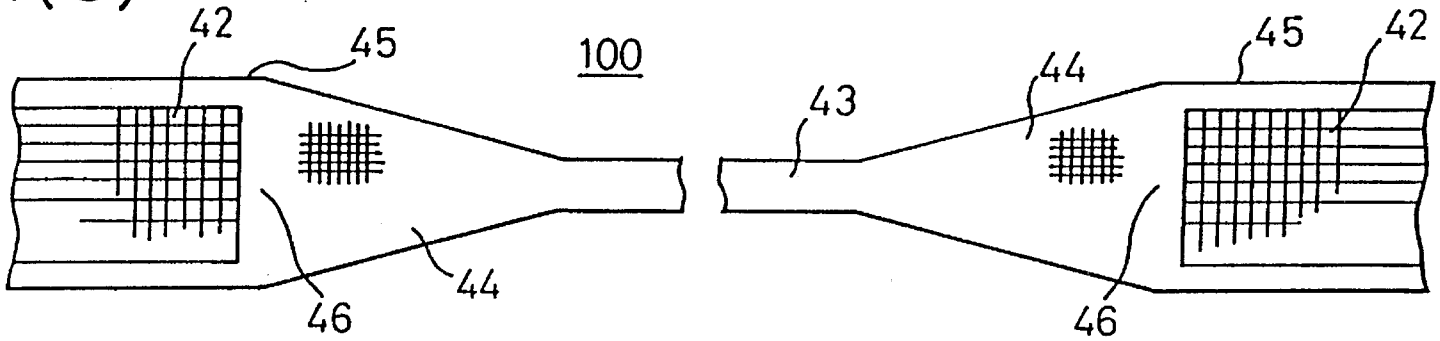
FIG. 4C is a view showing a sixth embodiment of the present invention.

FIG. 1 shows a definite example of a woven fabric which is divided in a transverse direction of the woven fabric into a mesh portion 2 and an ordinary woven fabric portion 3. FIG. 2 shows a definite example of a woven fabric which is classified in the transverse direction into a mesh portion 22 at the center and ordinary woven fabric portions 23 on both sides of the mesh portion 22. FIG. 3 shows a definite example of a woven fabric which is classified in the transverse direction into an ordinary woven fabric portion 33 at the center and mesh portions 32 on both sides of the woven fabric portion 23. FIG. 4A shows a definite example of a woven fabric, which is classified in a longitudinal direction into fabric portions having a predetermined length, and in which mesh portions 42 and ordinary woven portions 43 are alternately woven. FIG. 4B shows a modified example of FIG. 4A, in which ordinary woven fabrics are formed on both sides of a mesh portion 42. FIG. 4C shows a modified example of FIG. 4B, in which ordinary woven fabric portions are formed on both sides of the mesh portion 42, and the width of each woven fabric portion is gradually decreased from the distal end thereof and is changed into an ordinary woven fabric portion 43 having a smaller width than the mesh portion, as indicated by reference numeral 44. Further, a portion 44 has a gradually increasing width and next to this portion 44, a large width portion 46 consisting of the mesh portion 42 and ordinary woven fabric portions 45 on both sides of the mesh portion 42 is formed. This arrangement repeats in the fabric longitudinal direction. Each of the mesh portions shown in FIGS. 1, 2, 3, 4A, 4B and 4C has voids which an adhesive member enters at the time of bonding, and which exhibit a so-called "bridge effect". Accordingly, it is the portion that has a large peel strength and is suitable for bonding. On the other hand, the ordinary woven fabric portions 3, 23, 8 are those portions in which a hole 50 is bored so that these holes can be mutually connected by a rope, a tape, etc., and these portions are used for the original application of the woven fabric. Incidentally, the woven fabric according to the present invention preferably consists of a woven fabric having a small width as the principal member, and a woven fabric having a woven lug of not greater than 600 mm as its full width is preferably used.

The pitch of the holes used in the present invention and described above is preferably from 50 to 100 mm, for example, and the diameter of the holes is preferably from about 10 to about 12 mm, for example.

Next, some examples of means for obtaining the voids of the mesh portion will be described.

1) Twisting is preferably used for both warps and wefts lest the yarns do not flatly expand at the mesh portion.
2) When the warps have the same size, the voids are formed by reducing the number of warps per unit dimension of the mesh portion in comparison with the ordinary woven fabric portion.
3) When the warps have the same size, the voids are formed by paralleling at least two warps at the mesh portion.
4) The voids are formed by using yarns having a smaller size at the mesh portion than at the ordinary woven fabric portion.
5) The voids are formed by using the warps having a smaller size at the mesh portion and furthermore, by reducing the number of warps per unit dimension at the mesh portion.
6) The voids are formed by using the warps having a smaller size at the mesh portion and furthermore, by paralleling at least two warps.
7) The voids are formed by reducing the number of pitches of wefts per unit dimension only at the mesh portion when the fabric is divided in the transverse direction.
8) The voids are formed by reducing the number of pitches of the wefts per unit dimension at the mesh portion when the fabric is divided in the longitudinal direction.
9) The fabric structure of the mesh portion is constituted into a texture which has the voids formed by picking a plurality of wefts into the same shed.
10) The mesh portion is formed as a leno woven fabric so that a plurality of warps of the leno cloth move to the right and left.
11) The voids are formed by shaping the mesh portion as a mock leno woven fabric.
12) The voids are formed by combining a plurality of sets of the various means described above.

Which of these means for forming the voids are to be selected is determined depending on whether or not the strength in the direction of the weft is necessary, or in the direction of the warp, or both, in accordance with the application of the woven fabric to be woven.

Next, the size of the voids of the mesh portion and the void ratio will be described.

First, an experiment was carried out under the following conditions in order to determine the proportion of the size of the voids most suitable for bonding to the void portion per unit area.

1) Bonding material:

A 1 mm-thick tarpaulin sheet and a woven fabric sewn to the tarpaulin sheet for bonding a sheet.

2) Boring:

A round hole was bored by punching at the portion to which the woven fabric was sewn. The hole diameters were 2ϕ, 3ϕ and 4ϕ.

3) Number of holes:

The number of holes was decided in such a manner that when the unit area was 100%, the sum of the area of the 2ϕ holes substantially accounted for 5%, 10% and 15%. The 3ϕ and 4ϕ holes were bored so that their area accounted for 10% of the sum of the area, respectively.

4) Bonding medium:

A PVC film (1 mm-thick) which was the same as the resin used for the tarpaulin sheet main body.

5) Welding means: High frequency welder

6) Peel strength test:

Each sample was cut into a 40 mm width, and the peel strength was measured by a tensile tester by fitting the tarpaulin sheet and the woven fabric at the non-bonded portions to clamps (the worst condition which could not be assumed during practical use).

The following results were obtained by the experiment described above.

1) The peel strength of the woven fabric not having the holes bored therein was 5 kgf maximum.
2) When the void ratio was 10%, the peel strength became higher with a smaller hole diameter.
3) When the hole diameter was 2ϕ, the peel strength became higher with a higher void ratio.
4) When the hole diameter was 2ϕ and the void ratio was 10% and 15%, peel at the tarpaulin sheet main body portion was frequently observed.
5) When the tarpaulin sheet main bodies were mutually bonded, the peel strength was 24 kgf on an average.

It could be understood from the results of the experiment described above that when the total area of the hole diameter 2ϕ (area 3.14 $mm^2$) was 10% of the total area of the mesh portion, the peel strength was the highest, i.e., 23 kgf, which was approximately the strength when the tarpaulin sheet main bodies were bonded to each other. However, since it was not yet clear what results could be obtained when the hole area was below 3.14 $mm^2$ and when mesh-like holes were formed in the woven fabric, the experiments were further carried out by weaving various mesh-like woven fabrics.

The method of measuring the voids of the mesh-like woven fabrics will be described below (see FIG. 7).

The measurement method of the void ratio will be explained when the space portion in the mesh portion 9 of the woven fabric according to the present invention i.e., the void portion 13 is constituted by a leno weaving or plain mock leno, by way of example.

Figure 7:
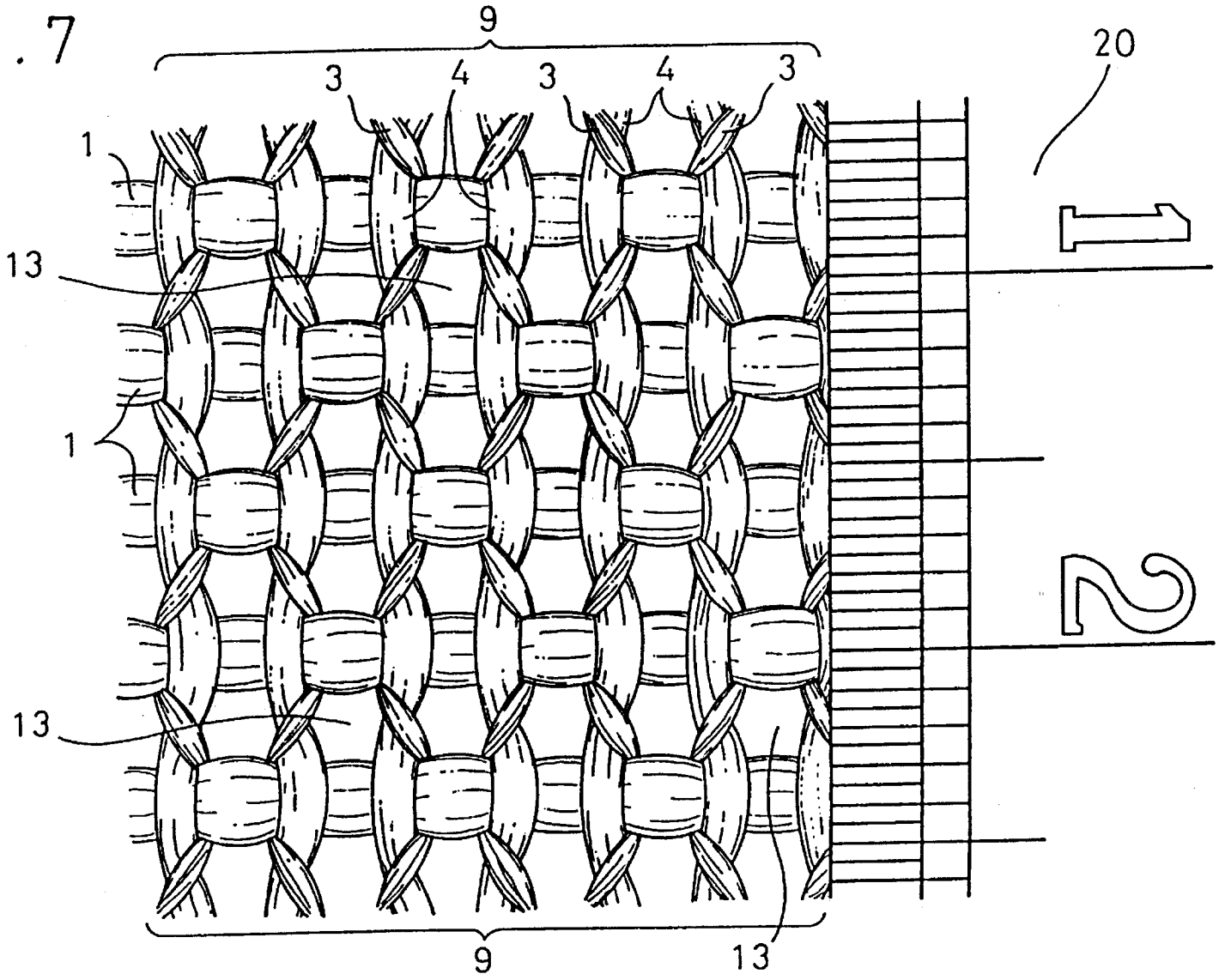
FIG. 7 is an enlarged schematic view of a weaving structure of a leno woven portion, and shows a method of measuring a void area.

The mesh portion 9 in FIG. 7 consists of leno ground yarns 4, leno yarns 3 and wefts 1, and space portions 13 are defined between the leno ground yarns 4 and the wefts 1.

In FIG. 7, a scale 20 is additionally shown to enable the size of the space to be more easily understood.

In other words, in FIG. 7, a close-up lens was attached to a camera, and after the scale was attached to a mesh-like woven fabric, their image was magnified 5 to 8 times, and the image was printed. The magnification ratio was read by the scale in the printed image, and the dimension of each space was measured and was converted to an actual size. Thereafter, the area was calculated. When the shapes of the spaces were not constant, the dimension of each portion was measured for each shape, and after the areas were calculated, their mean value was determined. The void ratio was calculated by first counting the number of spaces contained in unit area, then calculating the total void area by (areas of voids)×(number of voids), and dividing the total void area by the unit area. Though the void ratio calculated by this method was not an absolute value, it was the best approximate value that could be calculated.

It was found out as the result of experiments that the bridge effect could be obtained even when one void area was 0.25 $mm^2$.

Because the required peel strength differs depending on the application after the woven fabric is bonded, it is extremely difficult to stipulate the void ratio of the mesh portion in the present invention, but the value 3% was employed as the void ratio that provided at least 30% of the peel strength between the tarpaulin sheet main bodies as maximum. More concretely, the case where 75 voids exist in a unit area of 25 $mm^2$ when the void area is 0.25 $mm^2$ corresponds to the void ratio 3%.

On the other hand, the upper limit of the void ratio is set to 30% or below which is assumed to be the limit at which texture deviation difficultly occurs in the mesh portion after bonding. Further, when either the warps or the wefts of the mesh portion are below 50% with respect to the number of the warps and the number of the wefts picked per unit area of the ordinary portion, texture deviation becomes likely to occur.

The mesh portion must naturally have a higher breaking strength than the tarpaulin main body, and the breaking strength is preferably at least 300 kgf at a width of at least 40 mm. According to the results of the experiments carried out by the present inventors, the breaking strength in 40 mm width of a 1 mm-thick tarpaulin sheet main body is about 200 kgf.

There is a method which fits a woven fabric to the tarpaulin main body by sewing, and adding another tarpaulin sheet in such a manner as to clamp and cover the former and welding them together, as has also been executed in the past. The sewing means in this case can be replaced by the bonding means of the present invention. If this is done, the breaking strength can be further increased drastically. This is preferable as reinforcing means when the peel strength is believed insufficient.

Incidentally, as the result can also be obtained in the experiments, the bonding effect can also be obtained by boring the holes by fusing, punching, etc., in the woven fabric. In this case, holes having an excessively small size cannot be formed easily, but it is preferred to form the holes as small as possible and to secure a void ratio of at least 3%.

EXAMPLE 1

Loom used: narrow fabric needle loom

Fiber material: polyester multifilament yarns

Figure 5:
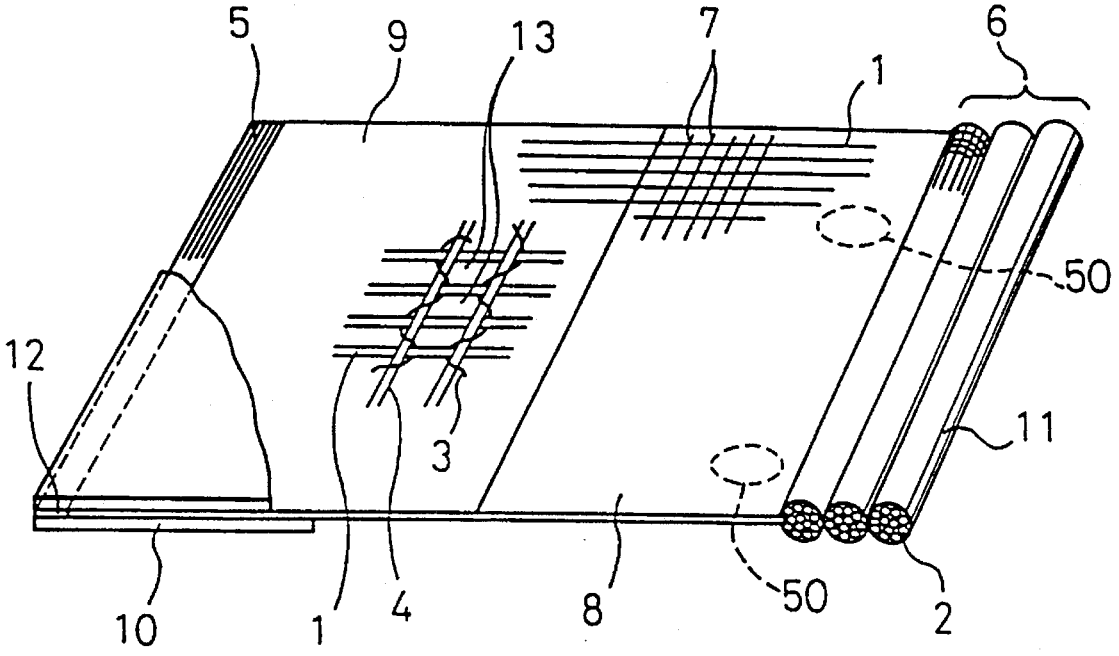
FIG. 5 is a perspective view showing a weaving structure of the first embodiment.

Weaving structure: shown in FIGS. 1 or 5

Weaving specification: warp ground yarn (7) 1,500 d//l 72 pcs (3/1·1·3 warp double weaving) (weaving width 37 mm)

Warp selvage yarn 1 (6) 1,500 d//l 56 pcs (1/1 double weaving) (weaving width 13 mm)

Warp selvage yarn 2 (5) 1,500 d//l 8 pcs (1/3, 8 pcs, apparently 1/1) (weaving width 5 mm)

Leno ground yarn (4) 1,500 d//l 72 pcs (4/4, apparently 2/2) (weaving width 45 mm)

Leno yarn (3) 1,000 d//l, 18 pcs

Warp core yarn (2) 1,500 d//l 80 pcs (double weaving, woven into selvage)

Weft (1) 1,500 d//l 28 Pic/30 mm (14 Pic/30 mm for leno portion and for leno selvage portion)

In the specification described above, the design was made so that the sewn portion of the woven fabric sewn into the sheet was suitable during use for bonding. An explanation will now be given of the mesh portion as the object of the present invention.

1) The number of leno ground yarns was 72, and they were divided into 18 groups of four, and the leno yarn was disposed in each of these groups. The leno yarn moved to the right and left sides of the four leno ground yarns and when they were bundled, a void was defined in the width-wise direction.

2) The weft was consecutively picked twice in the leno portion, and in two subsequent picking actions, the weft was picked into the portions other than the leno portion and the selvage yarn 2 while skipping the latter two. Accordingly, though the weaving texture was 4/4, the fabric had the form of apparent 2/2 plain weaving, and spaces were defined in the longitudinal direction of the leno portion.

3) Calculated from the yarns used and the number of wefts picked, the breaking strength of the leno portion in the width-wise direction was 400 kgf at 40 mm even when a strength utilization ratio was estimated at a low value of 80%. (In this example, a load acted in the direction of width).

4) The void area calculated by the afore-mentioned measurement method of the void area and the calculation method of the void ratio was 2.30 $mm^2$ and the void ratio was 21.7%.

5) When the peel strength was measured by the afore-mentioned experimental method, it was found to be 23.2 kgf at a width of 40 mm. This value was the strength that was considered sufficient for practical application for sheet connection.

The woven fabric of the definite example shown in FIG. 5 comprises the mesh portions 9 described above, the woven fabric main body portion 8, the thick warp selvage portion 11 with built-in core yarns 2 and the ordinary selvage portion 12, and furthermore, a film 10 as an adhesive is fitted to one, or both, of the surfaces of the mesh portion 9.

EXAMPLE 2

Loom used: narrow fabric needle loom,

Fiber material: polyester multifilament yarn, full width=128 mm

Weaving specification:

Warp ground yarn (7) 1,500 d//l, 235 pcs (3/1·1·3 warp double weaving) (weaving width 100 mm)

Leno ground yarn (4) 1,500 d//l, 40 pcs (2/2) (weaving width 30 mm)

Leno yarn (3) 1,000 d//l, 10 pcs.

Weft (1) 1,500 d//l, 28 Pic/30 mm

In the specification described above, the center portion was the mesh portion 22 and both sides of this mesh portion were ordinary texture woven fabric as shown in FIG. 2. An explanation will be given mainly for the mesh portion.

1) About 13.3 yarns existed at the center portion 22 in the 10 mm width and 23.5 yarns existed on both of sides of the 10 mm width. The number of yarns at the center portion was reduced to about 43.4% so as to form the voids in the width-wise direction.

2) The number of the leno ground yarns was 40. These ground yarns were divided into 10 groups of four, and the leno yarn was disposed in each of the groups. The leno yarn moved to the right and left of the four leno ground yarns and when bundled, it defined the voids in the width-wise direction.

3) The number of picking actions of the wefts was the same throughout the full width in view of the strength in the transverse direction. However, though the weaving texture was 2/2 at the leno portion, it was woven into a plain weave form, and defined slight voids in the longitudinal direction by gathering the wefts. The voids could be further expanded by using 3/3 or 4/4 in place of 2/2.

4) The breaking strength of the leno portion in the width-wise direction was calculated as 600 kgf at 40 mm, from the yarns used and the number of picking actions, even when the strength utilization ratio was estimated as a low value of 80%. (In this example, a load acted in the width-wise direction).

5) The void area calculated by the same void area measuring method as that of Example 1 and the calculation method of the void ratio was 1.36 $mm^2$, and the void ratio was 17.8%.

6) When the peel strength was measured by the aforementioned experimental method, it was 17.8 kgf, and when calculated in the 40 mm width, the value became 23.7 kgf. This value was the strength capable of sufficiently withstanding the practical application for fitting pipes of the tent.

EXAMPLE 3

Loom used: small width needle loom,

Fiber material: polyester multifilament yarn, full width 25 mm

Weaving specification:

Warp ground yarn (7) 1,000 d/l, 62 pcs. (1/1, ordinary portion, 1/1+3/3 mock leno weaving, mesh portion)

Wefts (1) 750 d/l 24 Pic/30 mm (ordinary portion) 18 Pic/30 mm (mesh portion)

In the specification described above, the ordinary portion used 1/1 plain, and predetermined portions in the longitudinal direction had the mesh portion. The explanation will be mainly given for the mesh portion (see FIG. 6).

Figure 6:
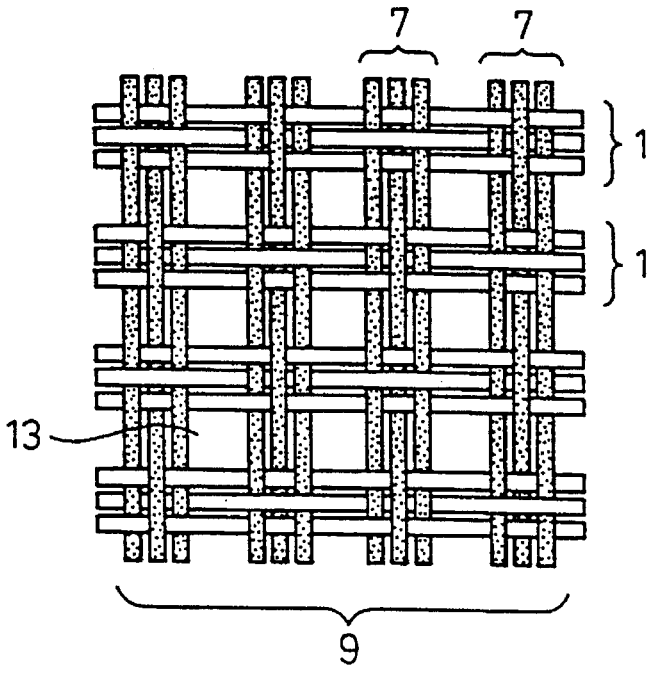
FIG. 6 is an enlarged schematic view of a weaving structure of a mesh portion of the third embodiment.

1) The mesh portion 9 was formed by a mock leno weave, which was likely to gather, by using three warps and wefts, and the number of picking actions of the warps was reduced to 3/4 of the ordinary portion so as to form the voids 13. FIG. 6 shows a schematic view of the mock leno weave.
2) Both warps and wefts were used as twisted yarns so that the yarns did not easily expand at the mesh portion 9.
3) The breaking strength of the mesh portion in the longitudinal direction was 450 kgf at the full width, and this value became 720 kgf when converted to the 40 mm width.
4) The void area of the mesh portion was 0.45 $mm^2$, and the void ratio was 6.2%.
5) The peel strength was 9.5 kgf at the full width of 25 mm. The peel strength test sample of this invention used the 40 mm width as the reference, and when the value given above was converted to the 40 mm width, it was about 15 kgf, and could withstand practical application.

EXAMPLE 4

The fourth example of the present invention relates to the woven fabric having the texture shown in FIG. 4C. A small width portion 43 at the center in FIG. 4C was woven into a thick small width woven fabric of the ordinary woven texture having a high tensile strength. Portions 44 connected to both ends of the small width portion 43 consisted of the ordinary woven texture, but their width gradually changed so as to connect a large width portion 46 to the small width portion.

The mesh portion 42 formed by the technical means described above and the ordinary woven fabric portions 45 on both sides of the mesh portion 42 were formed in the large width portion 46.

The void portions of the mesh portion 42 may be formed by punching, fusing, and so forth.

Incidentally, in the woven fabric according to the present invention, an adhesive may be applied to the mesh portions 2, 22, 9, 42, etc., having a large number of voids 13 so that these mesh portions 2, 9, 22, 42, etc., can be bonded to one another. Further, when the mesh portions 2, 9, 22, 42, etc., and sheets coated with a synthetic resin such as a tarpaulin are bonded through the adhesive, the adhesive permeates into the voids of the mesh portions 2, 9, 22, 42 and exhibits the bridge effect. Accordingly, extremely strong bond structures can be formed.

In the present invention, an eyelet structure 45 can be disposed by suitable means such as fusing, punching, etc., in the ordinary woven fabric structure portions 3, 8, 23, etc., so that the woven fabric can be connected to other sheets or ports by ropes, and so forth.

In the woven fabric having the structural portion suitable for bonding according to the present invention, the mesh portions 2, 22, 9, 32, 42, etc., having a large number of voids 13 may be mutually bonded by using an adhesive medium such as a synthetic resin film or an adhesive. Further, when the mesh portions and the sheets coated with a synthetic resin are similarly bonded, the adhesive member permeates into the voids of the mesh portions 2, 22, 9, 32, 42, etc., and exhibits the bridge effect, so that extremely strong bonding can be secured. The effects of the present invention will be described in detail below.

1) The work can be carried out extremely easily and speedily without any specific skill in comparison with bonding by sewing. Typical use examples are as follows.

a) A plurality of holes 50 are bored at portions near the reinforcing portion of the belt selvage by means such as punching, fusing, etc., with predetermined gaps between them, while the mesh portion 9 is bonded to both ends of the tarpaulin main body for wrapping an article. After the article is wrapped, both ends of the belt are butted, and the holes are mutually bonded by the tape or the rope. In this way, the woven fabric can be used as a belt for fitting the sheet.

b) In Example 2, a plurality of holes 50 are bored with predetermined gaps at suitable positions near both selvage of the belt of the ordinary woven fabric portion 23 by means such as punching, fusion, etc., as shown in FIG. 2, and the mesh portion 22 at the center is bonded to the tarpaulin tent base. The woven fabric can thus be used as the belt for fitting the tent sheet by wrapping tent skeletal pipes and bonding the holes to one another by the tape or the rope.

c) In Example 3, the mesh portions 32 are disposed on both sides and the ordinary woven fabric portion 33, at the center, as shown in FIG. 3. The tarpaulin main body is bonded to the mesh portions 32, and the woven fabric of the ordinary portion is used for the application of connection to other members.

d) In Example 4, the mesh portion 42 of the large width portion 46 is bonded to the main body bag portion of a flexible container, etc., and another tarpaulin sheet is put outside in such a manner as to cover the flexible container and is fused to the main body. In this case, the small width portion is used as a suspension grip. Because the width is small, it is easy to handle.

e) An example of use of FIG. 3 is as follows. Namely, another member is wrapped at the center portion 33, and the mesh portions 32 are mutually bonded to retain the member.

f) The tarpaulin main body can be reinforced by a woven fabric consisting of the mesh portion shown in FIGS. 1 to 3 as the principal body and having the ordinary portions of a reduced width, by connecting the woven fabric to necessary portions and ends of the tarpaulin main body.

2) When a woven fabric for fitting the tent to pipes is sewn, another sheet must be fused to the outside of this woven fabric in order to prevent leakage of water. When the woven fabric according to the present invention is used and fused, such a work becomes unnecessary.

3) When bonding means by thermal fusion is employed, the bonding work can be carried out on site, whenever necessary, and the woven fabric can be used extremely conveniently.

4) Generally, it is not easy to bond a woven fabric to another woven fabric, and moreover, they are likely to peel. However, the woven fabric according to the present invention can be easily bonded and moreover, it has a remarkably high peel strength. Accordingly, it expands the range of the application of the woven fabric.

5) The woven fabric has no offensive feel in comparison with sewn fabrics, and has excellent appearance.

We claim:

1. A woven fabric/plastic sheet combined structure comprising:

a woven fabric having warps and wefts and having at least one zone that extends partially in one of (a) a longitudinal direction, (b) a transverse direction, and (c) both the longitudinal direction and the transverse direction, at least one of the warps and wefts being more openly woven in said at least one zone than the rest to form a mesh portion; and a plastic film applied to at least one surface of said mesh portion such that material of the plastic film fills voids of the mesh portion, thereby firmly bonding the plastic film to the woven fabric.

2. A combined structure according to claim 1, wherein a sum of plastic filled void areas in said mesh portion is from 3 to 30% of the total surface area of said mesh portion.

3. A combined structure according to claim 1, wherein a full width is not greater than 600 mm.

4. A combined structure according to claim 2, wherein a full width is not greater than 600 mm.

5. A combined structure according to claim 1, wherein said plastic film is made of a material suitable for fusing with plastic sheet such as tarpaulin sheet.

6. A combined structure according to claim 1, wherein said woven fabric has, at a location other than said mesh portion, another plurality of holes adapted for receiving at least one of a tape and a rope.

7. A woven fabric/plastic sheet combined structure comprising:

a woven fabric having warps and wefts and having at least one zone that extends partially in one of (a) a longitudinal direction, (b) a transverse direction, and (c) both the longitudinal direction and the transverse direction, a plurality of small openings in said at least one zone formed by means such as melting, punching, or differentially weave, to provide a mesh portion, the sum of areas of said small openings being from 3 to 30% of a total surface area of said mesh portion; and a plastic film applied to at least one surface of said mesh portion so that material of the plastic film fills said small openings in the mesh portion, thereby firmly bonding the plastic film to the woven fabric.

8. A combined structure according to claim 7, wherein a full width is not greater than 600 mm.

9. A method for constructing a woven fabric/plastic sheet combined structure, comprising the steps of:

weaving a woven fabric having warps and wefts and having at least one zone that extends partially in one of (a) a longitudinal direction, (b) a transverse direction, and (c) both the longitudinal direction and the transverse direction, said weaving comprising the step of differentially weaving at least one of said warps and wefts to provide a more open weave in said at least one zone than the rest of said woven fabric, to form a mesh portion; and applying a plastic film to at least one surface of said mesh portion so that material of the plastic film fills voids of the mesh portion, thereby firmly bonding the plastic film to the woven fabric.

10. The method as recited in claim 9, wherein said material of said plastic film is molten when it fills said voids of said mesh portion.

* * * * *